US009788617B1

(12) United States Patent
Chen et al.

(10) Patent No.: US 9,788,617 B1
(45) Date of Patent: Oct. 17, 2017

(54) PULL RIB OF WIND-RESISTANT UMBRELLA

(71) Applicant: Xiamen Mingho Brothers MFG Co., Ltd., Xiamen (CN)

(72) Inventors: Tien-Cheng Chen, Xiamen (CN); Sun-Feng Sung, Xiamen (CN)

(73) Assignee: XIAMEN MINGHO BROTHERS MFG CO., LTD., Xiamen, Fujian (CN)

( * ) Notice: Subject to any disclaimer, the term of this patent is extended or adjusted under 35 U.S.C. 154(b) by 0 days.

(21) Appl. No.: 15/279,445

(22) Filed: Sep. 29, 2016

(51) Int. Cl.
*A45B 25/22* (2006.01)
*A45B 19/10* (2006.01)
*A45B 25/02* (2006.01)

(52) U.S. Cl.
CPC ..... *A45B 25/22* (2013.01); *A45B 19/10* (2013.01); *A45B 25/02* (2013.01)

(58) Field of Classification Search
CPC ..... A45B 25/22
See application file for complete search history.

(56) References Cited

U.S. PATENT DOCUMENTS 539,762 A * 5/1895 Barnett ..... A45B 25/22 135/27
559,577 A * 5/1896 Hadfield ..... A45B 25/22 135/27
5,284,172 A * 2/1994 Teate, Jr. ..... A45B 25/02 135/27
5,794,637 A * 8/1998 Figueroa ..... A45B 25/22 135/27
6,186,157 B1 * 2/2001 Lin ..... A45B 25/22 135/25.1
6,588,439 B2 * 7/2003 Wu ..... A45B 19/10 135/27
6,601,597 B2 * 8/2003 Sung ..... A45B 25/02 135/29
6,612,320 B2 * 9/2003 Lin ..... A45B 25/22 135/33.41
6,863,081 B2 * 3/2005 Hsieh ..... A45B 25/02 135/25.3
7,415,986 B2 * 8/2008 Wu ..... A45B 25/22 135/31
9,301,582 B2 * 4/2016 Haythornthwaite ... A45B 25/22
2003/0178050 A1 * 9/2003 Wu ..... A45B 25/22 135/32
2004/0238020 A1 * 12/2004 Lee ..... A45B 25/22 135/31
2005/0022458 A1 * 2/2005 Ko ..... A45B 25/22 52/3

(Continued)

*Primary Examiner* — David R Dunn
*Assistant Examiner* — Danielle Jackson
(74) *Attorney, Agent, or Firm* — Leong C. Lei

(57) ABSTRACT

Disclosed is an improved pull rib structure of a wind-resistant umbrella. The pull rib includes a rigid pull bar section and a flexible pull wire connected to each other. The pull wire has a free end that is coupled through a tighten-up device to the outer rib. The tighten-up device includes a position-restoration member arranged therein to connect to the free end of the pull wire and apply a position-restoration driving force to the pull wire. The tighten-up device keeps the pull wire in a stretched and tight condition during collapsing of umbrella so as to prevent entangling and ensure a smooth opening operation and service life of the umbrella.

4 Claims, 9 Drawing Sheets

(56) References Cited

U.S. PATENT DOCUMENTS

| | | | | |
|---|---|---|---|---|
| 2005/0051202 | A1* | 3/2005 | You | A45B 25/22<br>135/27 |
| 2014/0209132 | A1* | 7/2014 | Landry | A45B 25/22<br>135/27 |
| 2015/0096601 | A1* | 4/2015 | Haythornthwaite | A45B 25/22<br>135/22 |
| 2015/0265013 | A1* | 9/2015 | Jenan | A45B 19/00<br>135/28 |

* cited by examiner

PULL RIB OF WIND-RESISTANT UMBRELLA

(a) TECHNICAL FIELD OF THE INVENTION

The present invention relates generally to an umbrella, and more particularly to an improved pull rib of a wind-resistant umbrella.

(b) DESCRIPTION OF THE PRIOR ART

Umbrellas are a commonly used everyday-living article for sheltering rain, shading sunlight, and shielding wind. One common problem that the general public may encounter in using umbrellas is that strong winds or gusts may blow the umbrella inside out in a windy raining or stormy day, making the umbrella no longer working for sheltering and shielding, and also readily causing damage to the umbrellas, particularly multiple-sectioned umbrellas.

A wind-resistant umbrella frame is available for use with dual-canopy umbrella to guide out airflows and thus ensure the service life of the umbrellas. As shown in FIGS. 1 and 2, such an umbrella frame structure comprises inner ribs 1, intermediate ribs 2, outer ribs 3, and stretchers 11 and also comprises a pull rib 4. The pull rib 4 is comprises of a rigid pull rib section 41 and a flexible pull wire 42. The pull rib section 41 has a free end that is connected to an inner end of the intermediate rib 2. The pull wire 42 has a free end fixedly connected to the outer rib 3 at a location in the proximity of an outer end there. Such a wind-resistant umbrella frame provides an effective support to an upper canopy and also shows advantages including simple structure and firm support. The pull rib 4 is arranged to provide a pull force to the outer rib 3 in order to prevent the umbrella frame from turning inside out by winds collected inside the canopy. However, the flexible pull wire 42, when slackened or relaxed in collapsing the umbrella, may readily lead to entangling, eventually causing undesired difficult in opening the umbrella, and even causing damage to the umbrella.

SUMMARY OF THE INVENTION

An object of the present invention is to provide an improved pull rib of a wind-resistant umbrella frame, which helps prevent entangling and ensure smooth opening of the umbrella and the service life of the umbrella.

To achieve the above object, the present invention provides a solution as follows:

A pull rib structure of a wind-resistant umbrella is provided, wherein the wind-resistant umbrella frame comprises an inner rib, an intermediate rib, an outer rib, and a stretcher, and further comprises a pull rib, the pull rib comprising a rigid pull bar section and a flexible pull wire connected to each other, the pull bar section having a free end connected to an inner end of the intermediate rib, the pull wire having a free end fixedly connected to the outer rib, wherein the free end of the pull wire is connected through a tighten-up device to the outer rib so that the tighten-up device is mounted to the outer rib and the tighten-up device comprises a position-restoration member that is connected to the free end of the pull wire and applies a position-restoration driving force to the pull wire.

The tighten-up device comprises a slide track that defines a stroke of movement and an extend-through hole that receives the pull wire to extend therethrough into the slide track.

The position-restoration member comprises a compression spring received in the slide track, the compression spring having an end fixed to a front end of the slide track, the free end of the pull wire that extends through the extend-through hole into the slide track being arranged to further extend through a central hole of the compression spring to connect to a free end of the compression spring.

The tighten-up device has an outer wall in which a fitting slot is formed to receive the outer rib to fit and fix therein.

The tighten-up device is alternatively fixed by adhesives to the outer rib.

The position-restoration member alternatively comprises a tension spring, which has an end fixed to a rear end of the slide track, the pull wire extending through the extend-through hole of the tighten-up device to connect to a free end of the tension spring.

The position-restoration member alternatively comprises a set of magnets, one of which is fixed to a rear end of the slide track, the pull wire extending through the extend-through hole of the tighten-up device to connect to another one of the magnets.

The tighten-up device is integrally formed with the umbrella bead and/or the outer rib.

By adopting the above solution, the present invention provides a pull rib structure of a wind-resistant umbrella, wherein the pull wire is coupled, through a tighten-up device that allows the pull wire to selectively extend and retract, to the outer rib so as to keep the pull wire constantly in a stretched and tight condition during closing of the umbrella thereby preventing the issue of entangling of the pull rib resulting from relaxing and slackening of the pull wire and ensuring a smooth operation of opening umbrella and the service life of the umbrella.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
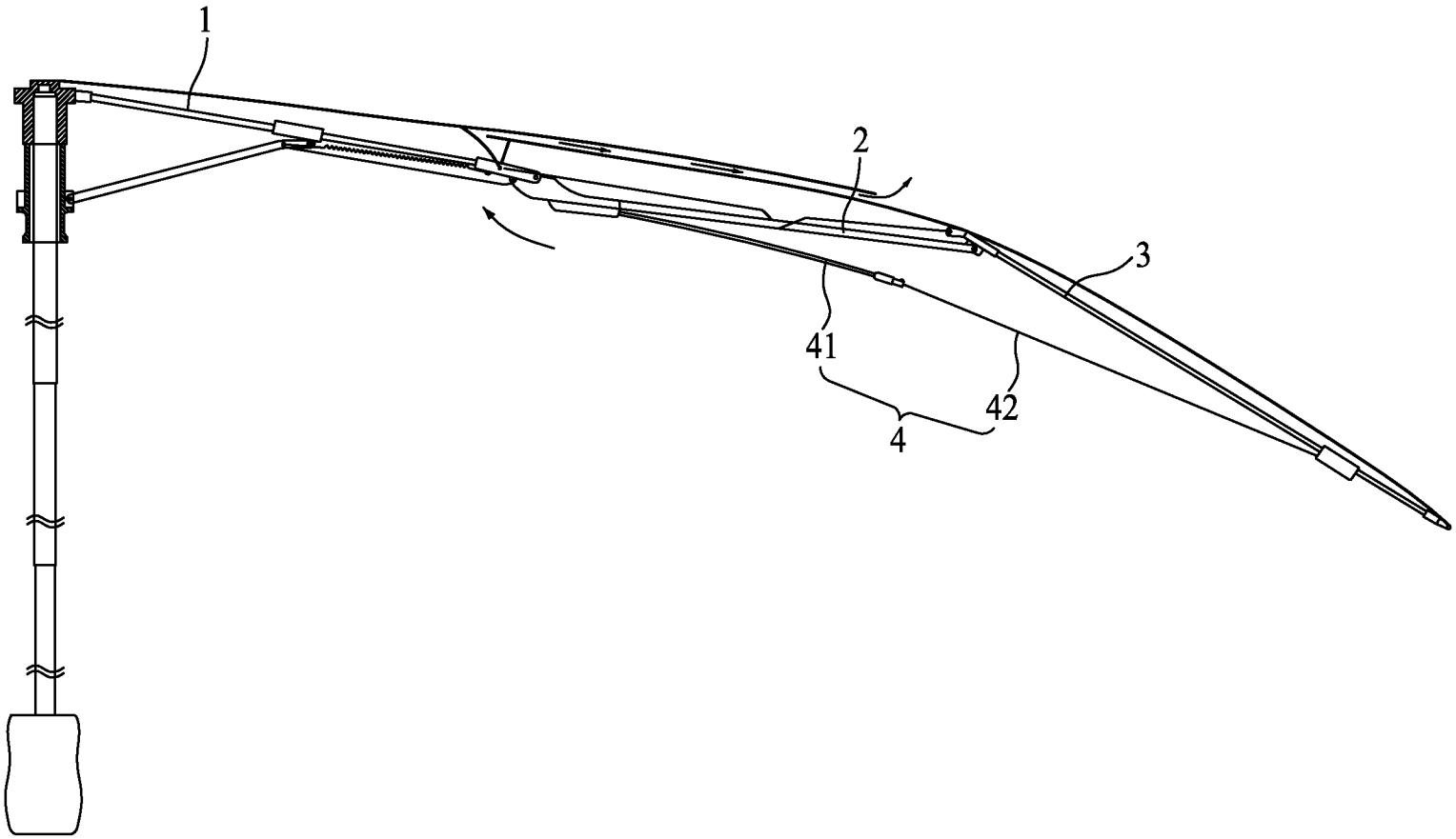
F I G. 1 Prior Art
FIG. 1 is a schematic view showing a prior art wind-resistant umbrella.
Figure 2:
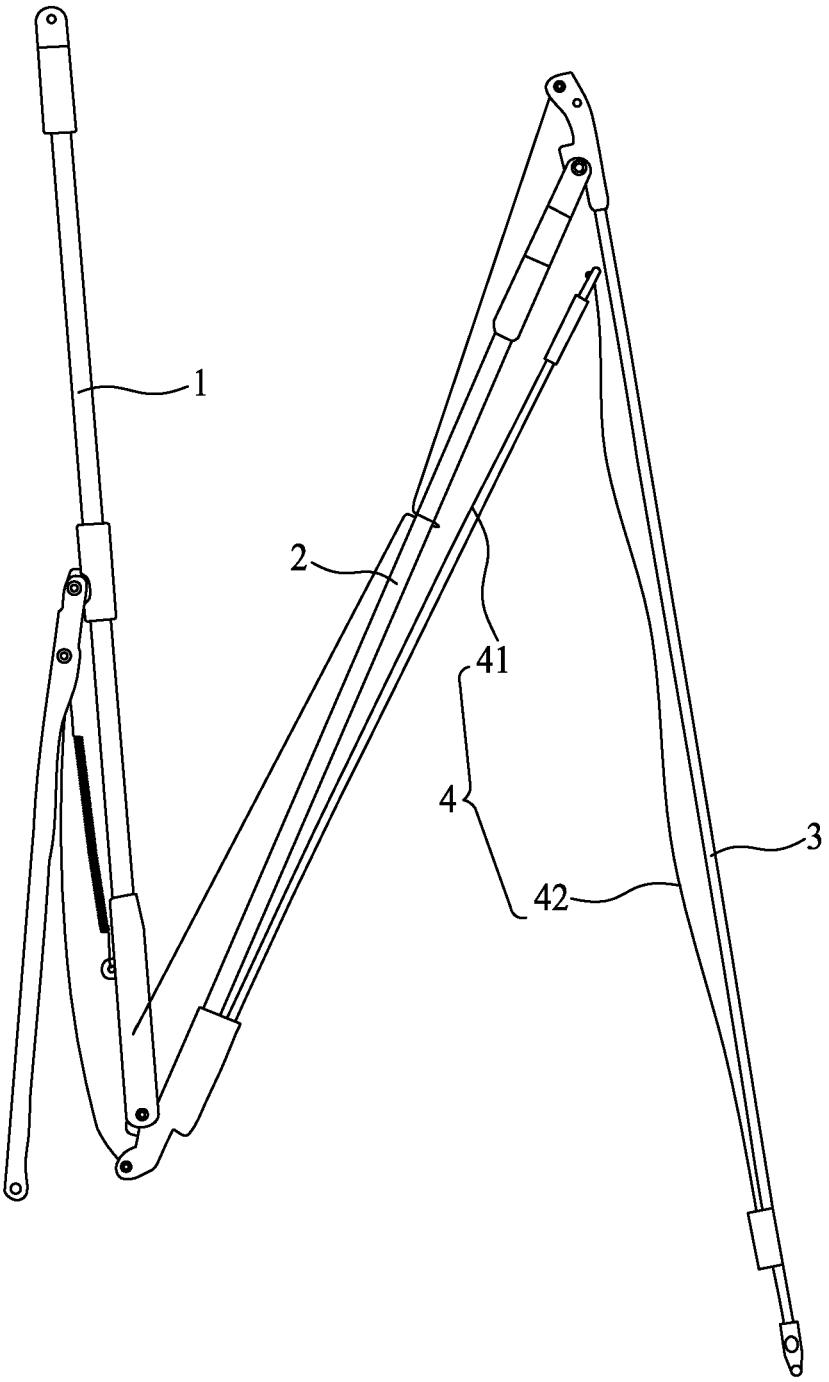
F I G. 2 Prior Art
FIG. 2 is a schematic view illustrating collapsing of the prior art wind-resistant umbrella frame.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

For better expounding the technical solution proposed in the present invention, embodiments are discussed and explained below for providing a detailed description of the present invention.

In the description of the present invention, it is noted that the terminology for indication of direction or positional relationship, such as "front", "rear", "top", "bottom", "left", "right', "inside", and "outside" generally refers to the direction or positional relationship as shown in the attached drawings or the relative position that a product shows in a viewer's eyesight during daily uses, and is involved for the purpose of easing the description and simplifying the illustration of the present invention, rather than suggest, implicitly or explicitly, a device or a component must hold or be kept at a specific direction or structured or operated at a specific direction and should not be construed as limitation to the scope of the present invention.

As shown in FIGS. 3-7, the present invention provides an improved pull rib structure of a wind-resistant umbrella. A wind-resistant umbrella frame comprises an inner rib 1, an intermediate rib 2, an outer rib 3, and a stretcher 11, and further comprises a pull rib 4. The inner rib 1 has an inner end pivotally connected to a top crown C of the umbrella. The inner rib 1 is pivotally connected, through a first pivot joint 6, to the intermediate rib 2. The intermediate rib 2 has an outer end that is pivotally connected, through a second pivot joint 7, to the outer rib 3. A return wire of the intermediate rib 2 and a collapse spring are respectively connected to the stretcher 11 and the first pivot joint 6. A return wire of the outer rib 3 is connected to the intermediate rib 2 and the outer rib 3. The outer rib 3 has an outer end that is connected to an annular lower canopy. The stretcher 11 is pivotally connected to a runner G that is slidably up and down along an umbrella post and has an opposite end pivotally connected to the inner rib 1. The pull rib 4 is connected to the first pivot joint 6 and the outer rib 3. The pull rib 4 comprises a rigid pull bar section 41 and a flexible pull wire 42 that are connected to each other. The rigid pull bar section 41 has a free end connected to the first pivot joint 6, and the pull wire 42 has a free end connected to the outer rib 3.

Features of the present invention are as follows. The free end of the pull wire 42 is connected through a tighten-up device 5 to the outer rib 3. In other words, the tighten-up device 5 is mounted on the outer rib 3 and the tighten-up device 5 is provided therein with a position-restoration member that is connected to the free end of the pull wire 42 and applies position-restoration driving force to the pull wire 42.

The tighten-up device 5 comprises a slide track 51 that defines a stroke or a path of movement, and an extend-through hole 52 that receives the pull wire 42 to extend therethrough and reach into the slide track 51. The position-restoration member comprises a compression spring 53 received in the slide track 51. The compression spring 53 has an end fixed to a front end of the slide track 51. The free end of the pull wire 42 extends through the extend-through hole 52 to reach into the slide track 51 and run through a central hole of the compression spring 53 to be fixed to a free end of the compression spring 53.

The tighten-up device 5 has an outer wall that is further provided with a fitting slot 54 formed therein to receive the outer rib 3 to fit and thus be fixed therein. The tighten-up device 5 is fixed to the outer rib 3 at a location adjacent to an umbrella bead. It is obvious that the tighten-up device 5 can be fixed to the outer rib 3 by means of adhesives or other fixing measures.

Figure 5:
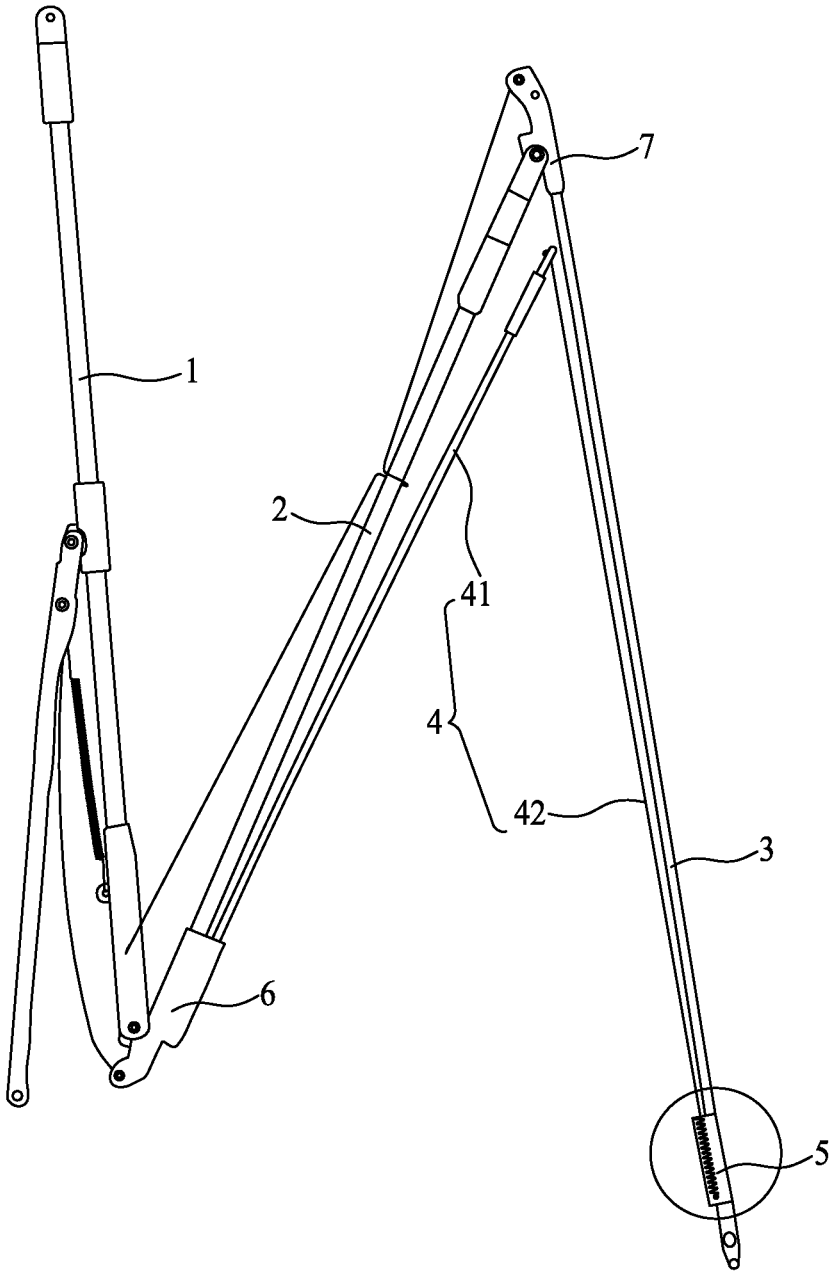
FIG. 5 is a schematic view illustrating collapsing of the wind-resistant umbrella frame according to the present invention.
Figure 6:
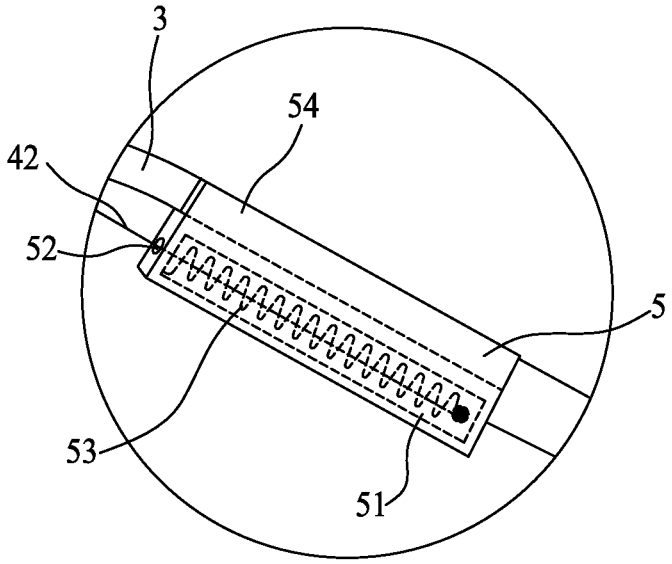
FIG. 6 is an enlarged view of a circled portion of FIG. 5.
Figure 7:
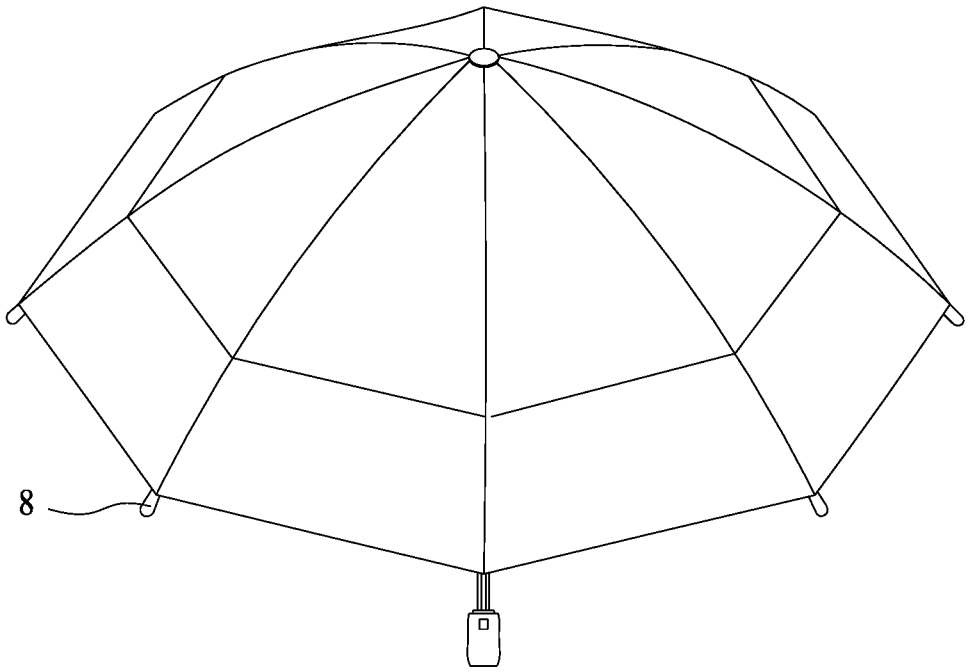
FIG. 7 is a schematic view illustrating a wind-resistant umbrella frame according to the present invention.

As shown in FIGS. 5 and 6, in a closed condition of the umbrella, the free end of the pull wire 42 is subjected to a position restoration operation by the compression spring 53 so that the free end of the pull wire 42 is kept to extend to a rear end of the slide track 51. In other words, a portion of the pull wire 42 is located in and extends through the tighten-up device 5 so that the pull wire 42 is kept in a stretched condition without causing slackening or relaxing that leads to entangling.

Figure 3:
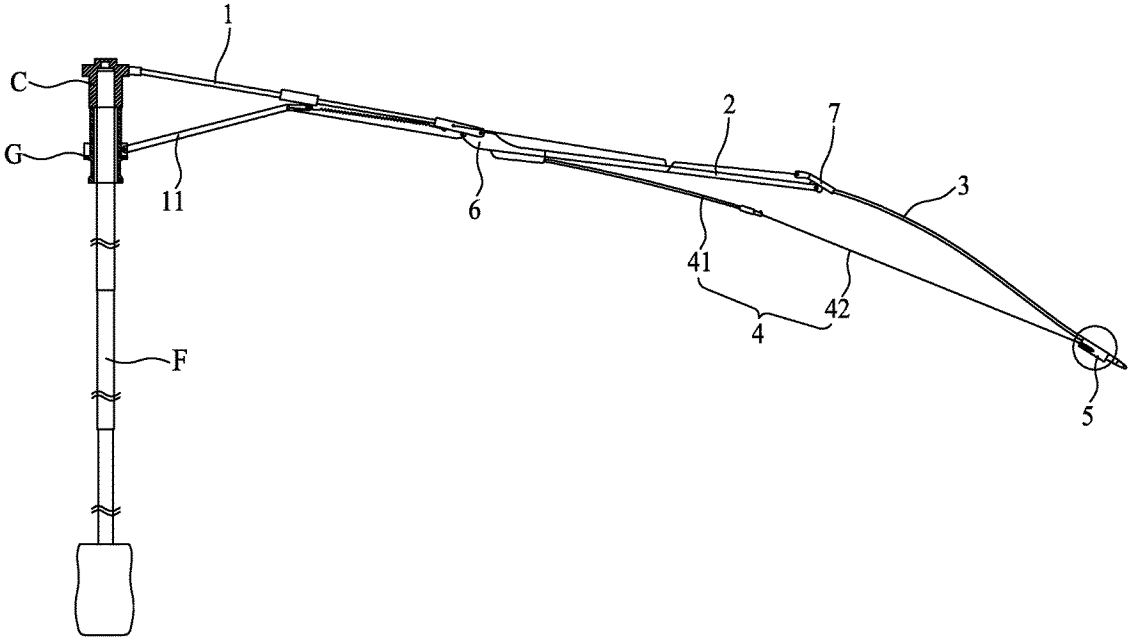
FIG. 3 is a schematic view showing a wind-resistant umbrella frame according to the present invention.
Figure 4:
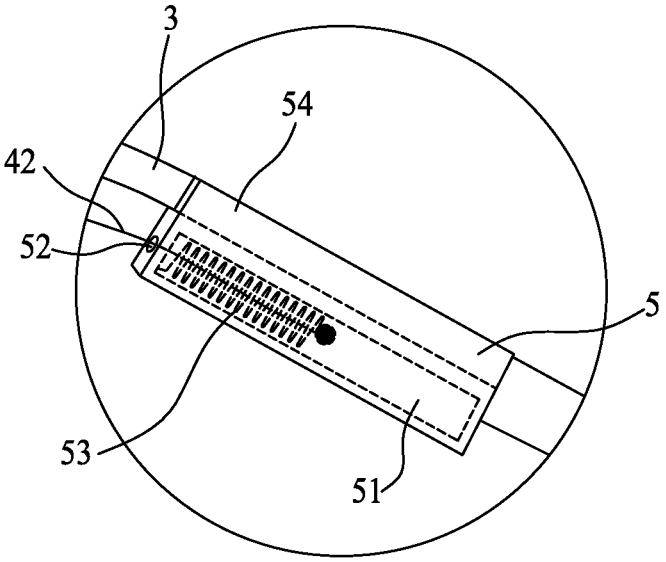
FIG. 4 is an enlarged view of a circled portion of FIG. 3.

As shown in FIGS. 3 and 4, in an open condition of the umbrella, when the opposite end of the stretcher 11 follows the upward movement of the runner G to push up and thus expand the inner rib 1, the return wire of the intermediate rib 2 applies a force to a joint of the first pivot joint to the intermediate rib 2 in a direction toward the central post so as to expand the outer rib 3 during the expansion of the intermediate rib 2. Expanding of the outer rib 3 generates a pull force that pulls the free end of the pull wire 42 to move toward the front end of the slide track 51 of the tighten-up device 5. Under this condition, the compression spring 53 is set in a stretched and energy-accumulated condition and the pull wire 42 is in a stretched and tight condition, where the pull rib 4 defines a triangle arrangement with respect to the intermediate rib 2 and the outer rib 3 and a pull force is applied to the outer rib 3 to prevent the umbrella frame from turning inside out due to wind collected in the canopy.

To close the umbrella, the runner G moves downward and all ribs and parts move opposite to the operation of opening umbrella discussed above. Under this condition, the position-restoration force of the compression spring 53 guides the free end of the pull wire 42 to move toward the rear end of the slide track 51 so as to constantly keep it in a stretched and tight condition during the closing of the umbrella and no slackening or relaxing may occur.

Figure 8A:
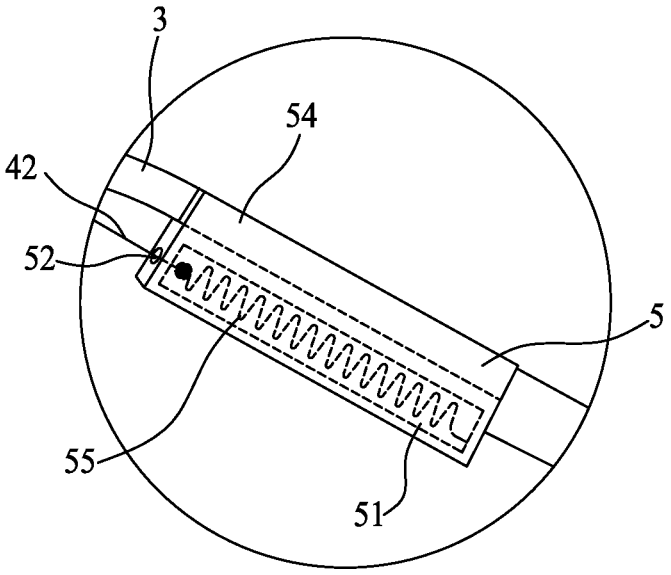
FIG. 8A is a schematic view showing a tighten-up device according to another embodiment of the present invention in an umbrella-opened condition.
Figure 8B:
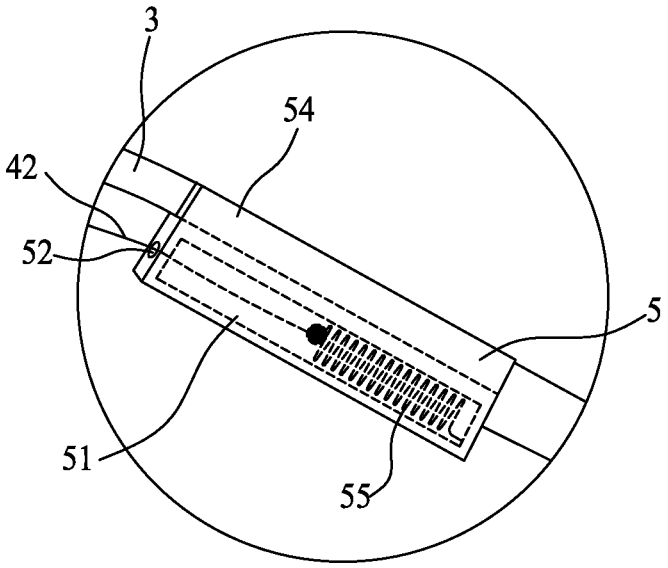
FIG. 8B is a schematic view showing the tighten-up device according to said another embodiment of the present invention in an umbrella-closed condition.

As shown in FIGS. 8A and 8B, the position-restoration member may alternatively be arranged as a tension spring 55, of which an end is fixed to the rear end of the slide track 51. The pull wire 42 extends through the extend-through hole 52 of the tighten-up device 5 to connect to a free end of tension spring 55. This similarly allows the pull wire 42 to be movable frontward/rearward in the slide track 51 and being acted upon by tension spring 55 to constantly maintain a stretched and tight condition.

Figure 9A:
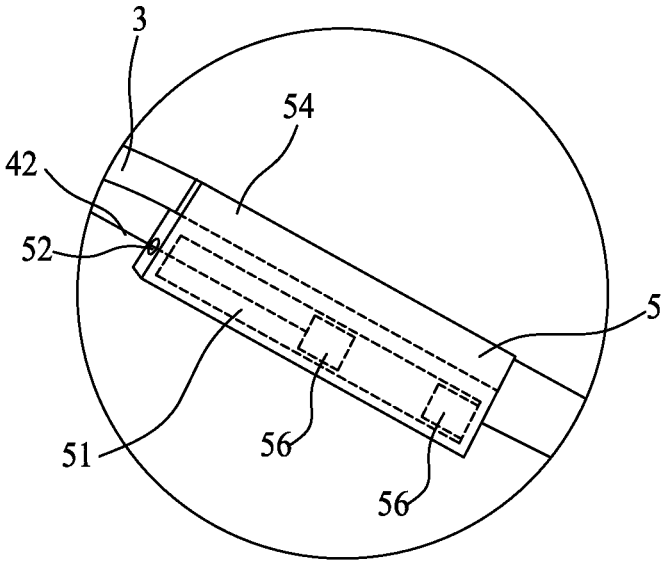
FIG. 9A is a schematic view showing a tighten-up device according to a further embodiment of the present invention in an umbrella-opened condition.
Figure 9B:
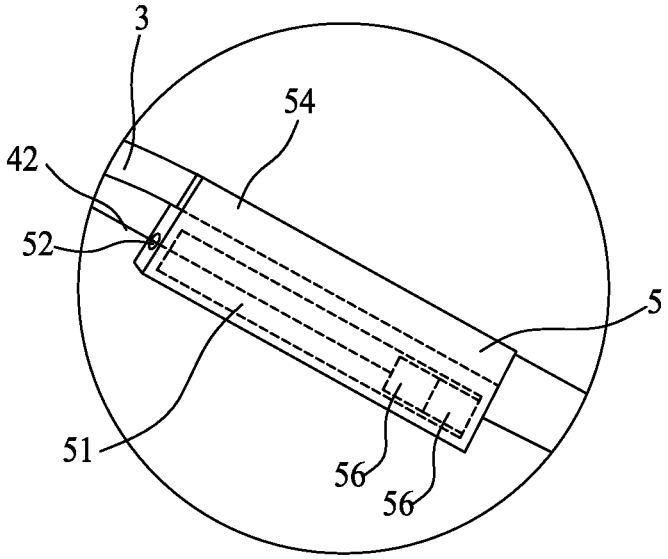
FIG. 9B is a schematic view showing the tighten-up device according to said further embodiment of the present invention in an umbrella-closed condition.

As shown in FIGS. 9A and 9B, the position-restoration member may further alternatively comprise a set of magnets 56, one of which is fixed to the rear end of the slide track 51. The pull wire 42 extends through the extend-through hole 52 of the tighten-up device 5 to connect to another one of magnets 56. Magnetic attraction between the two magnets 56 similarly provides a pulling effect to the pull wire 42 to make the pull wire 42 constantly in a stretched and tight condition.

It is also noted that in the three embodiments discussed above, the tighten-up device 5 does not need to be mounted individually to the outer rib 3 and can be alternatively integrated with the umbrella bead 8 and the outer rib 3.

In summary, the present invention provides a pull rib structure of a wind-resistant umbrella, wherein the pull wire 42 is coupled, through a tighten-up device 5 that allows the pull wire 42 to selectively extend and retract, to the outer rib 3 so as to keep the pull wire 42 constantly in a stretched and tight condition during closing of the umbrella thereby preventing the issue of entangling of the pull rib resulting from relaxing and slackening of the pull wire 42 and ensuring a smooth operation of opening umbrella and the service life of the umbrella.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

We claim:

1. A pull rib structure of a wind-resistant umbrella, wherein the wind-resistant umbrella frame comprises an inner rib, an intermediate rib, an outer rib, and a stretcher, and further comprises a pull rib, the pull rib comprising a rigid pull bar section and a flexible pull wire connected to each other, the pull bar section having a free end connected to an inner end of the intermediate rib, the pull wire having a free end fixedly connected to the outer rib, wherein the free end of the pull wire is connected through a tighten-up device to the outer rib so that the tighten-up device is mounted to the outer rib and the tighten-up device comprises a position-restoration member that is connected to the free end of the pull wire and applies a position-restoration driving force to the pull wire;

wherein the tighten-up device comprises a slide track that defines a stroke of movement and an extend-through hole that receives the pull wire to extend therethrough into the slide track; and wherein the position-restoration member comprises a set of magnets, one of which is fixed to a rear end of the slide track, the pull wire extending through the extend-through hole of the tighten-up device to connect to another one of the magnets such that the magnets generates a force, serving as the position-restoration driving force, applied to the pull wire to keep the pull wire in a stretched and straight condition.

2. The pull rib structure of the wind-resistant umbrella according to claim 1, wherein the tighten-up device has an outer wall in which a fitting slot is formed to receive the outer rib to fit and fix therein.

3. The pull rib structure of the wind-resistant umbrella according to claim 1, wherein the tighten-up device is fixed by adhesives to the outer rib.

4. The pull rib structure of the wind-resistant umbrella according to claim 1, wherein the tighten-up device is integrally formed with an umbrella bead and/or the outer rib.

* * * * *